US006270180B1

(12) United States Patent
Arakawa et al.

(10) Patent No.: US 6,270,180 B1
(45) Date of Patent: Aug. 7, 2001

(54) INK JET PRINTER

(75) Inventors: Hiroaki Arakawa; Yoshikazu Maekawa; Takashi Horiyama; Kazuo Asano, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/148,043

(22) Filed: Sep. 3, 1998

(30) Foreign Application Priority Data

Sep. 8, 1997 (JP) ..... 9-242500

(51) Int. Cl.[7] ..... B41J 29/38

(52) U.S. Cl. ..... 347/14; 347/9; 347/5; 347/10; 347/11; 347/17

(58) Field of Search ..... 347/17, 14, 19, 347/5, 11, 10, 13, 9

(56) References Cited

U.S. PATENT DOCUMENTS

| | | | | |
|---|---|---|---|---|
| 5,172,134 | * | 12/1992 | Kishida et al. | 347/13 |
| 5,760,797 | * | 6/1998 | Koizumi et al. | 347/14 |
| 5,992,963 | * | 11/1999 | Miyake et al. | 347/17 |
| 6,079,805 | * | 6/2000 | Kishi | 347/9 |
| 6,116,713 | * | 9/2000 | Maru | 347/17 |

FOREIGN PATENT DOCUMENTS

| | | | | |
|---|---|---|---|---|
| 0 390 202 | | 10/1990 | (EP) . | |
| 0 627 313 | | 12/1994 | (EP) . | |
| 59-133062 | | 7/1984 | (JP) . | |
| 8-295015 | | 11/1996 | (JP) . | |
| 08295015 | * | 11/1996 | (JP) | B41J/2/045 |
| WO 97/35167 | | 9/1997 | (WO) . | |

* cited by examiner

*Primary Examiner*—John Barlow
*Assistant Examiner*—An H. Do
(74) *Attorney, Agent, or Firm*—Frishauf, Holtz, Goodman, Langer & Chick, P.C.

(57) ABSTRACT

In an ink jet printer provided with a printing head having an ink chamber, a piezoelectric element and a nozzle tip; the printer is further provided with a drive signal generating circuit for generating drive signals corresponding to image information, a temperature sensor for measuring the temperature of the printing head; and a heating signal generating circuit for generating a heating signal on the basis of the temperature of the printing head measured by the temperature sensor. The piezoelectric element vibrates in response to the heating signal and generates heat so that the ink in the ink chamber is heated.

16 Claims, 11 Drawing Sheets

INK JET PRINTER

BACKGROUND OF THE INVENTION

The present invention relates to an ink jet printer, and specifically to an ink jet printer usable as a hard copy apparatus in which an image data from a computer is recorded by a jet of ink.

Conventionally, in a printer in which recording is conducted by binary gradation data, ON/OFF recording is conducted corresponding to binary data.

For example, in an ink jet printer, image data for each one-jetting of each nozzle of a print head having a plurality of jet nozzles is transferred to a driving IC of the head for each time, and ink-jetting is conducted by transferred image data and an image is formed.

FIG. 11 is an illustration showing a drive signal waveform supplied to a head and conditions of jetting a drop of liquid in a jet nozzle, as a model. As shown in FIG. 11, the following processes are repeated by the drive signal waveform, in which a jetting nozzle composed of a piezo-element, or the like, is expanded (①→②), then, contracted (③) and jets a drop of liquid of ink, and returns again to an initial condition (④).

Recently, gradation recording is conducted in various types of printers, and conducted also in an ink jet printer in the same manner as other printers.

As a gradation recording method, there is a method in which the number of dots jetted for a pixel is changed. According to this method, by changing the number of dots to be jetted, the same effect can be obtained as that obtained when dimensions of a dot at jetting are changed.

Incidentally, there is sometimes a case where a sufficient jetting can not be conducted when viscosity of ink is changed by the temperature change. In this case, ink jetting can not be accurately conducted, resulting in a decrease of image quality.

Generally, viscosity is increased two times every time when temperature decreases by 10° C. Therefore, when an ink jet printer is used in the low temperature environment such as early in the morning in winter, sufficient ink jetting can not be carried out for a period of time after the start of the printer.

Further, even if the ink jet printer is warmed up after its start, the temperature of ink of unused color is not increased, thereby, sufficient ink jetting can not be carried out.

Further, the head is in an air-cooled condition by the movement of the head, the temperature of the unused color ink tends to be lowered. Further, even in the used color ink, the overall head is in the water-cooled condition when the cooled ink passes through the nozzle, and therefore, the temperature is hardly increased.

Due to such the problems, a proposal is made in Japanese Patent Publication Open to Public Inspection No. 133062/1984, in which the ink is heated by providing a heater near the head of the ink jet printer.

However, when the heater is provided as described above, there are following problems:

(1) the number of parts is increased near the head, and the structure becomes complicated;
(2) it is difficult to widely control heating of the ink in a liquid accommodation chamber in the head;
(3) efficiency is low when the heating of the ink in a liquid accommodation chamber in the head is widely controlled;
(4) power consumption due to a heater resistance body is large.

Further, in the ink jet printer having heads for a plurality of colors for color image formation, a problem also occurs in which color balance is lost if the temperature of each head is not almost the same. Further, it is extremely difficult to maintain the head temperature of each color uniform even when the heating control by the above-described heater is applied.

SUMMARY OF THE INVENTION

An object of the present invention is to solve the above problems and to provide an ink jet printer in which bad influence upon the image caused by the change of the ink viscosity due to temperature can be avoided while refraining the structure of the head from being complicated.

The invention as a means for solving the problem will be described below.

(1) An ink jet printer which conducts image recording by jetting liquid drops of ink from a leading end of a nozzle of a head, comprising: a drive signal generating means for generating a drive signal to jet the ink according to image information; a piezoelectric means for applying pressure onto a liquid accommodation chamber according to the drive signal; a temperature measuring means for measuring the temperature of the head; and a heating signal generating means for generating a heating signal to heat the ink in the liquid accommodation chamber by generating a heat by vibration by the piezoelectric means.

That is, in this invention of the ink jet printer, the ink in the liquid accommodation chamber adjacent to the piezoelectric means is heated by thermal conduction from the piezoelectric means heated by the heating signal applied to the piezoelectric means, without a jet of liquid drops from the leading end of the nozzle.

Accordingly, the piezoelectric means for jetting the ink is used also for heating the ink, thereby, bad influence upon an image caused by the change of the ink viscosity due to the temperature can be avoided, without providing any outside fitting part for heating near the head.

(2) The ink jet printer according to Item (1), wherein the heating signal generating means generates the heating signal at the time of non-recording.

That is, in this invention of the ink jet printer, the ink in the liquid accommodation chamber adjacent to the piezoelectric means is heated by thermal conduction from the piezoelectric means heated by the heating signal applied to the piezoelectric means, at the time of non-recording, without a jet of liquid drops from the leading end of the nozzle.

Accordingly, the piezoelectric means for jetting the ink is used also for heating the ink, and the ink is heated at the time of non-recording, thereby, bad influence upon an image caused by the change of the ink viscosity due to the temperature can be avoided, without providing any outside fitting part for heating near the head.

(3) The ink jet printer according to Item (1), wherein the heating signal generating means generates the heating signal when the head exists outside the image formation area.

That is, in this invention of the ink jet printer, the ink in the liquid accommodation chamber adjacent to the piezoelectric means is heated by thermal conduction from the piezoelectric means heated by the heating signal applied to the piezoelectric means when the head exists outside the image formation area, without a jet of liquid drops from the leading end of the nozzle.

Accordingly, the piezoelectric means for jetting the ink is used also for heating the ink, and the ink is heated when the head exists outside the image formation area, thereby, bad influence upon an image caused by the change of the ink viscosity due to the temperature can be avoided, without providing any outside fitting part for heating near the head.

(4) The ink jet printer according to Items (1) to (3), wherein the heating signal generating means controls the amplitude of the heating signal according to the measurement result of the temperature measuring means.

That is, in this invention of the ink jet printer, the ink in the liquid accommodation chamber adjacent to the piezoelectric means is heated by thermal conduction from the piezoelectric means heated by the heating signal whose amplitude is changed corresponding to the temperature, without a jet of liquid drops from the leading end of the nozzle.

Accordingly, the piezoelectric means for jetting the ink is used also for heating the ink, and the ink is heated by the heating signal whose amplitude is controlled, thereby, bad influence upon an image caused by the change of the ink viscosity due to the temperature can be avoided, without providing any outside fitting part for heating near the head.

In this case, because the amplitude is proportional to energy, the energy for heating is increased by increasing the amplitude. Accordingly, when the amplitude of the heating signal is controlled, delicate temperature adjustment or quick heating can also be carried out.

(5) The ink jet printer according to Items (1) to (3), wherein the heating signal generating means controls a heating signal frequency according to the measurement result of the temperature measuring means.

That is, in this invention of the ink jet printer, the ink in the liquid accommodation chamber adjacent to the piezoelectric means is heated by thermal conduction from the piezoelectric means heated by the heating signal whose frequency is changed corresponding to the temperature, without a jet of liquid drops from the leading end of the nozzle.

Accordingly, the piezoelectric means for jetting the ink is used also for heating the ink, and the ink is heated by the heating signal whose frequency is controlled, thereby, bad influence upon an image caused by the change of the ink viscosity due to the temperature can be avoided, without providing any outside fitting part for heating near the head.

In this case, because the frequency is proportional to energy, the energy for heating is increased by increasing the frequency. Accordingly, when the frequency of the heating signal is controlled, delicate temperature adjustment or quick heating can also be carried out.

(6) An ink jet printer which conducts image recording by jetting liquid drops of ink from leading ends of nozzles of a plurality of heads, comprising: a drive signal generating means for generating a drive signal to jet the ink of each head according to image information; a piezoelectric means for applying pressure onto a liquid accommodation chamber of each head according to the drive signal; a temperature measuring means for measuring the temperature of the plurality of heads; a heating signal generating means for generating respectively a heating signal to heat the ink in the liquid accommodation chamber by generating a heat by vibration by the piezoelectric means of each head; and a control means for selectively applying either of the drive signal or the heating signal onto the piezoelectric means.

That is, in this invention of the ink jet printer, the ink in the liquid accommodation chamber adjacent to the piezoelectric means is heated by thermal conduction from the piezoelectric means heated by the heating signal applied onto the piezoelectric means, without a jet of liquid drops from the leading ends of a plurality of nozzles.

Accordingly, the piezoelectric means for jetting the ink is used also for heating the ink, thereby, bad influence upon an image caused by the change of the ink viscosity due to the temperature can be avoided, without providing any outside fitting part for heating near each head.

(7) The ink jet printer according to Item (6), wherein the control means selects the heating signal at the time of non-recording and applies it onto the piezoelectric means.

That is, in this invention of the ink jet printer, the ink in the liquid accommodation chamber adjacent to the piezoelectric means is heated by thermal conduction from the piezoelectric means heated by the heating signal applied onto the piezoelectric means, at the time of non-recording of each head, without a jet of liquid drops from the leading end of the nozzle.

In this case, even if any of heads is in a recording condition, heating by vibration can be carried out for other heads in a non-recording condition.

Accordingly, the piezoelectric means for jetting the ink is used also for heating the ink, and the ink is heated at the time of non-recording of each head, thereby, it is not necessary to provide any outside fitting part for heating near each head, and bad influence upon an image caused by the change of the ink viscosity due to the temperature can be avoided.

(8) The ink jet printer according to Item (6), wherein the control means selects the heating signal when the head exists outside the image formation area, and applies the signal onto the piezoelectric means.

That is, in this invention of the ink jet printer, the ink in the liquid accommodation chamber adjacent to the piezoelectric means is heated by thermal conduction from the piezoelectric means heated by the heating signal applied to the piezoelectric means when each head exists outside the image formation area, without a jet of liquid drops from the leading end of the nozzle.

Accordingly, the piezoelectric means for jetting the ink is used also for heating the ink, and the ink is heated when each head exists outside the image formation area, thereby, bad influence upon an image caused by the change of the ink viscosity due to the temperature can be avoided, without providing any outside fitting part for heating near each head.

(9) The ink jet printer according to items (6) to (8), wherein the heating signal generating means controls respectively the amplitude of the heating signal according to the measurement result of the temperature measuring means.

That is, in this invention of the ink jet printer, the ink in the liquid accommodation chamber adjacent to the piezoelectric means is heated by thermal conduction from the piezoelectric means heated by the heating signal whose amplitude changes corresponding to the temperature, without a jet of liquid drops from the leading end of the nozzle.

Accordingly, the piezoelectric means for jetting the ink is used also for heating the ink, and the ink is heated by the heating signal whose amplitude is controlled for each head, thereby, bad influence upon an image caused by the change of the ink viscosity due to the temperature can be avoided, without providing any outside fitting part for heating near each head.

In this case, because the amplitude is proportional to energy, the energy for heating is increased by increasing the amplitude. Accordingly, when the amplitude of the heating signal is controlled, delicate temperature adjustment or quick heating for each head can also be carried out.

(10) The ink jet printer according to Items (6) to (8), wherein the heating signal generating means respectively controls the frequency of the heating signal according to the measurement result of the temperature measuring means.

That is, in this invention of the ink jet printer, the ink in the liquid accommodation chamber adjacent to the piezoelectric means is heated by thermal conduction from the piezoelectric means heated by the heating signal whose frequency changes corresponding to the temperature, without a jet of liquid drops from the leading end of the nozzle.

Accordingly, the piezoelectric means for jetting the ink is used also for heating the ink, and the ink is heated by the heating signal whose frequency is controlled for each head, thereby, bad influence upon an image caused by the change of the ink viscosity due to the temperature can be avoided, without providing any outside fitting part for heating near each head.

In this case, because the frequency is proportional to energy, the energy for heating is increased by increasing the frequency. Accordingly, when the frequency of the heating signal is controlled, delicate temperature adjustment or quick heating for each head can also be carried out.

(11) Incidentally, in each invention of the above (1) to (10), not only the piezoelectric means, but also the driver IC for generating the heating signal is heated in the same manner as the piezoelectric means, and the ink is heated also by the thermal conduction from the driver IC.

DETAILED DESCRIPTION OF THE PREFERRED EMBODIMENT

Figure 1:
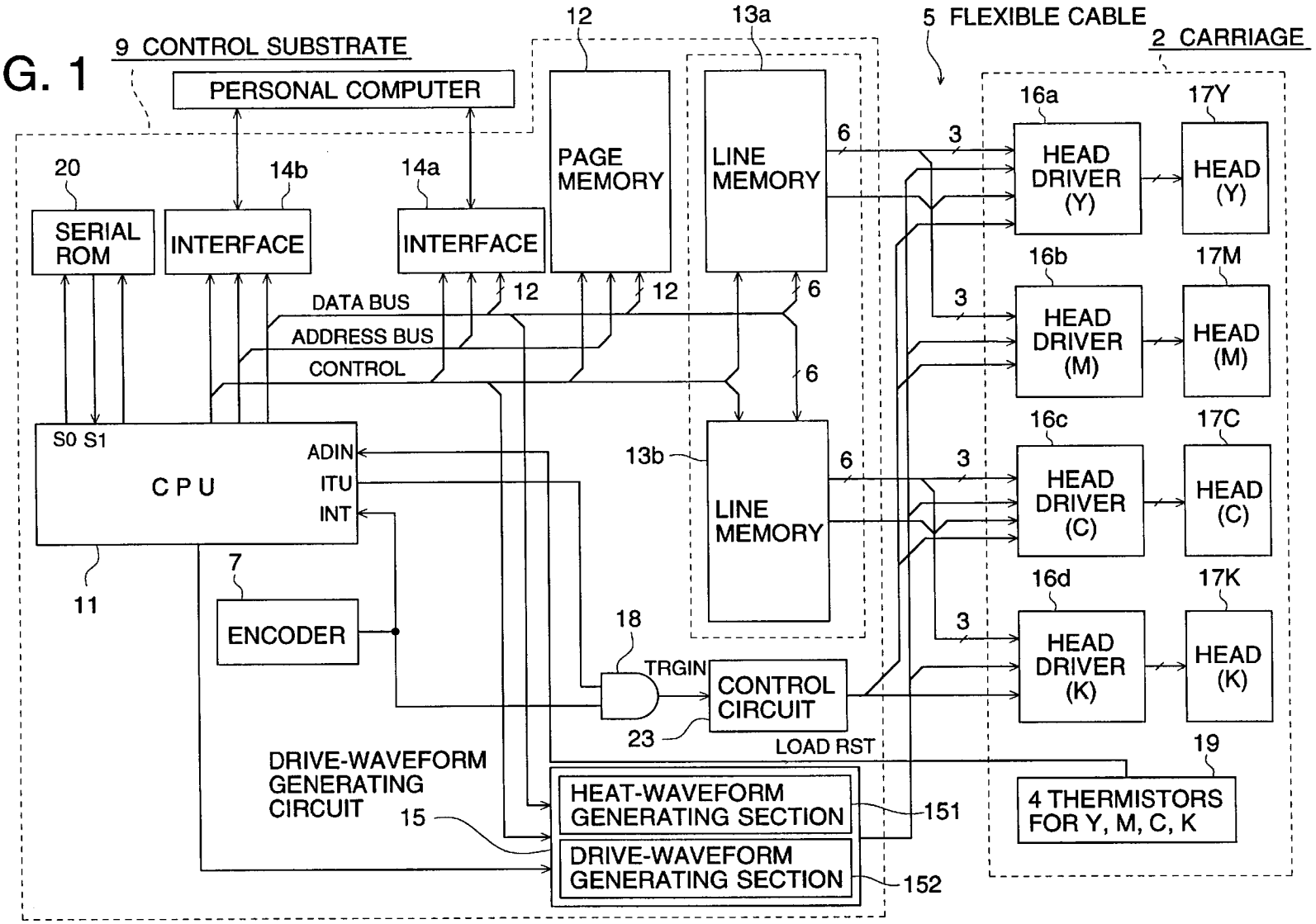
FIG. 1 is a circuit block diagram showing overall circuit structure of an ink jet printer 1.

Referring to the drawings, examples of the present invention will be described below.

<The Mechanical Structure of an Ink Jet Printer>

Figure 3:
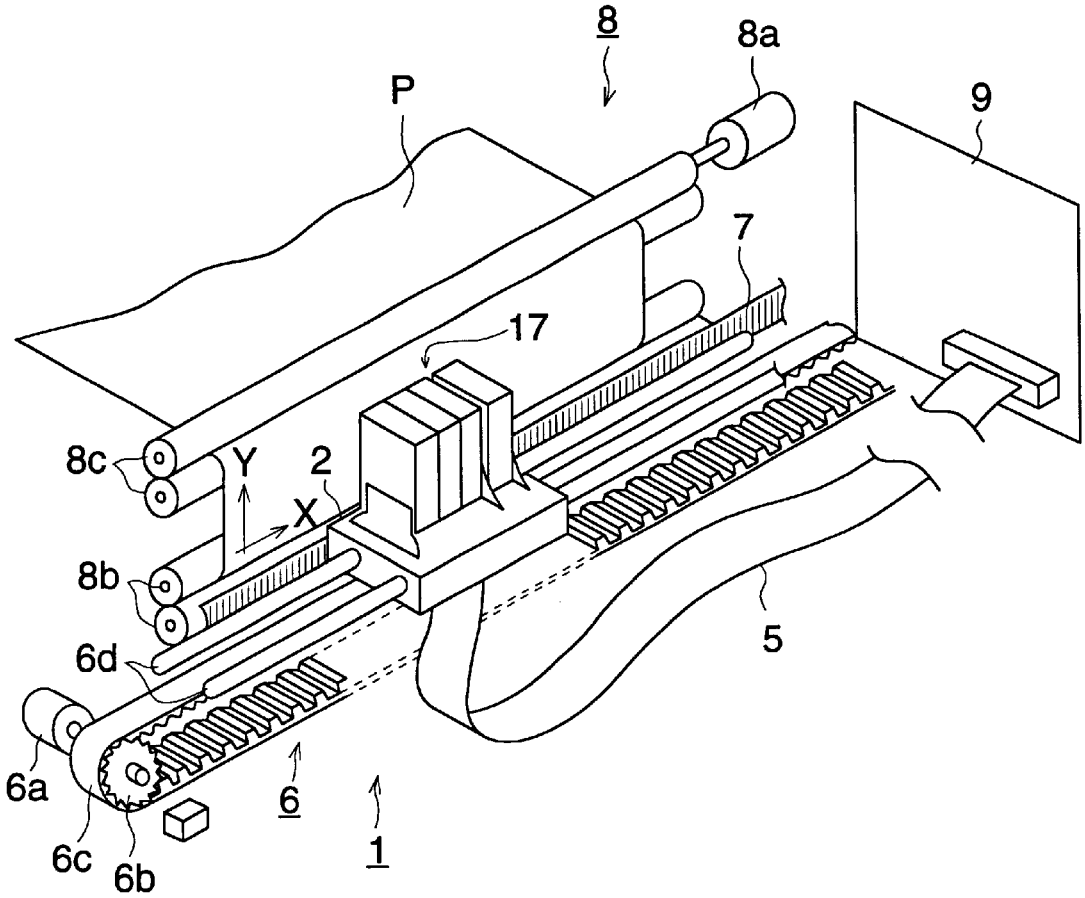
FIG. 3 is a perspective view showing the circumstances in the vicinity of a head of the ink jet printer.

Initially, referring to FIG. 3, the mechanical structure near a head which is a primary portion of the ink jet printer, will be described.

A carriage 2 is a case formed of resin in which a head 17 and a head driver 16 are housed. The head driver 16 housed in the carriage 2 is composed of ICs, and is connected to a control substrate 9 with a flexible cable 5 drawn out from the carriage 2.

The carriage 2 is reciprocated by a carriage driving mechanism 6 in the primary scanning direction shown by an arrow X in the drawing. The carriage driving mechanism 6 is composed of a motor 6*a*, pulley 6*b*, toothed belt 6*c*, and guide rails 6*d*, and the carriage 2 is fixed onto the toothed belt 6*c*.

When the pulley 6*b* is rotated by the motor 6*a*, the carriage 2 fixed onto the toothed belt 6*c* is moved in the direction shown by the arrow X in the drawing. The guide rails 6*d* are 2 rods in parallel to each other, and penetrate insert holes of the carriage 2 so that the carriage 2 slide on the rods.

Accordingly, the toothed belt 6*c* is not bent by the self weight of the carriage 2, and the direction of the reciprocation of the carriage 2 is linear. When the rotational direction of the motor 6*a* is reversed, the movement direction of the carriage 2 can be changed, and when the number of rotations is changed, the moving speed of the carriage 2 can also be changed.

An ink cartridge 4 houses an ink tank therein. An ink supply port of the ink tank is opened when the ink cartridge 4 is set to the carriage 2 and is connected to a supply pipe, and is closed when the connection is released, and the ink is supplied to the head 17.

The head 17 is provided on the carriage 2, and a situation in which heads 17 for four colors are provided on the carriage 2, is shown here. The ink cartridges in each of which the ink for each color of Y, M, C, K to be jetted, is accommodated, can be attached to and detached from the back of the heads 17. Incidentally, it is neglected to show the ink cartridge in FIG. 3.

The flexible cable 5 is used as a data transfer means, and is made by printing wiring patterns including data signal lines, power lines, or the like, on a flexible film. It transfers data between the carriage 2 and the control substrate 9, and follows the movement of the carriage 2.

An encoder 7 is marked with scales at a predetermined interval on a transparent resin film, and the scale is detected by an optical sensor provided on the carriage 2, and the movement speed of the carriage is detected.

A sheet conveyance mechanism 8 is a mechanism to convey a recording sheet P in the subsidiary scanning direction shown by an arrow Y in the drawing, and is composed of a conveyance motor 8*a*, conveyance roller pairs 8*b*, and 8*c*. The conveyance roller pair 8*b* and the conveyance roller pair 8*c* are driven by the conveyance motor 8*a*, and are roller pairs rotated by a gear train, not shown in the drawing, at almost equal peripheral speed, but the peripheral speed of the conveyance roller pair 8*c* is slightly higher than that of the conveyance roller pair 8*b*.

The recording sheet P is nipped by the conveyance roller pair 8*b* which is rotated at constant speed, after the recording sheet P is fed from a sheet feeding mechanism (not shown), then its conveyance direction is changed to the subsidiary scanning direction by a sheet feed guide (not shown), and it is conveyed while being nipped by the conveyance roller pair 8*c*.

Because the peripheral speed of the conveyance roller pair 8*c* is slightly higher than that of the conveyance roller pair 8*b*, the recording sheet P passes through a recording section without any slack. Further, the speed at which the recording sheet P is moved to the subsidiary scanning direction is set at constant speed.

While the recording sheet P is being moved at constant speed in the subsidiary scanning direction as described above, the carriage 2 is moved in the primary scanning direction at constant speed, and the ink jetted from the head 17 is adhered onto the recording sheet P so that an image is recorded within a predetermined range on a single side of the recording sheet P.

Figure 4:
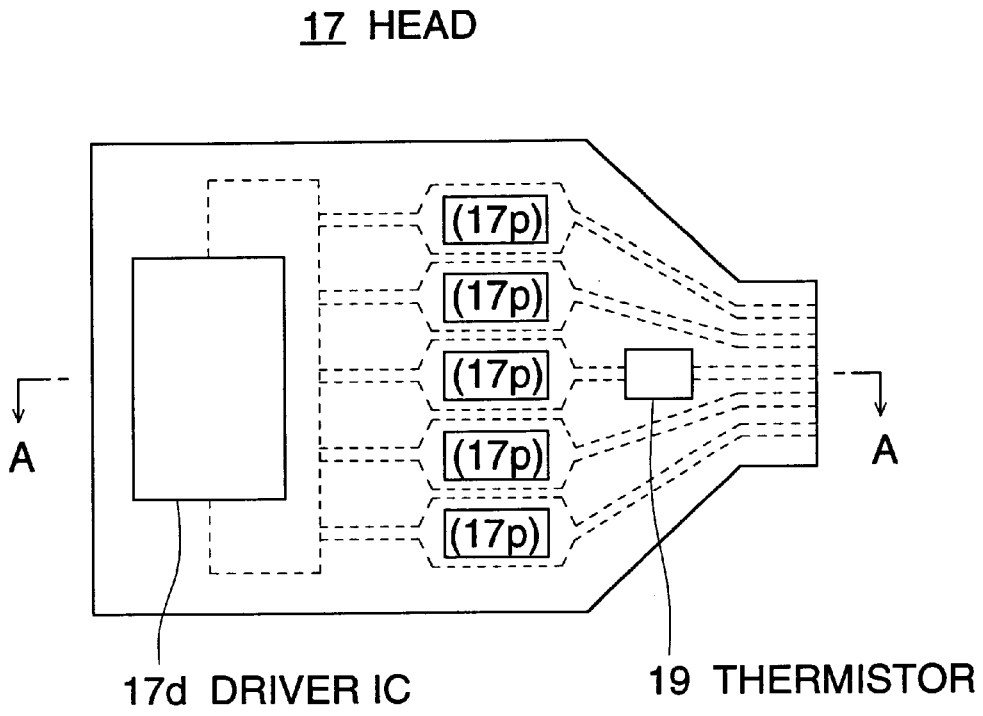
FIGS. 4(*a*) and 4(*b*) are sectional views showing the circumstances in the vicinity of a head of the ink jet printer.
Figure 4:
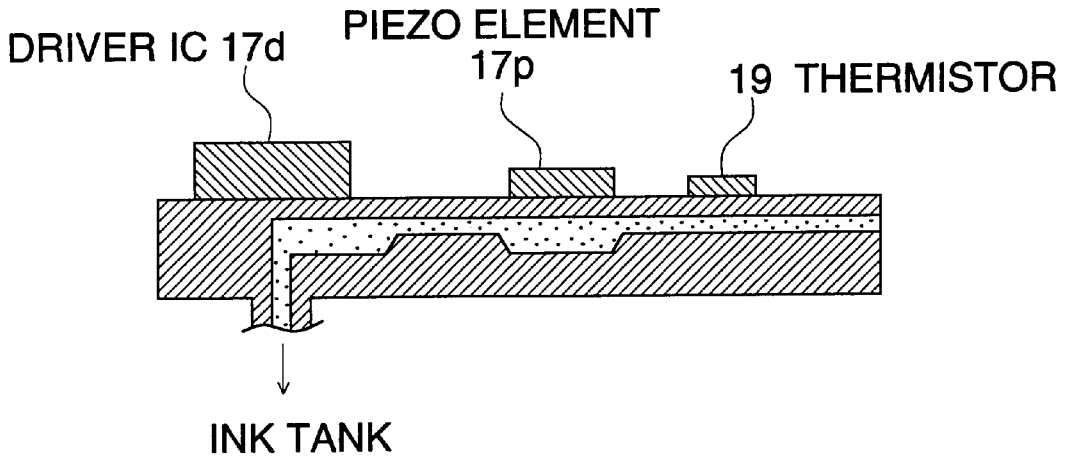

Incidentally, in the structure as described above, the structure of the head 17 is shown in FIG. 4. For the convenience of explanation, a head having 5 jet nozzles is shown as an example, however, in practice, the head is structured with a larger number of jet nozzles.

Figure 11:
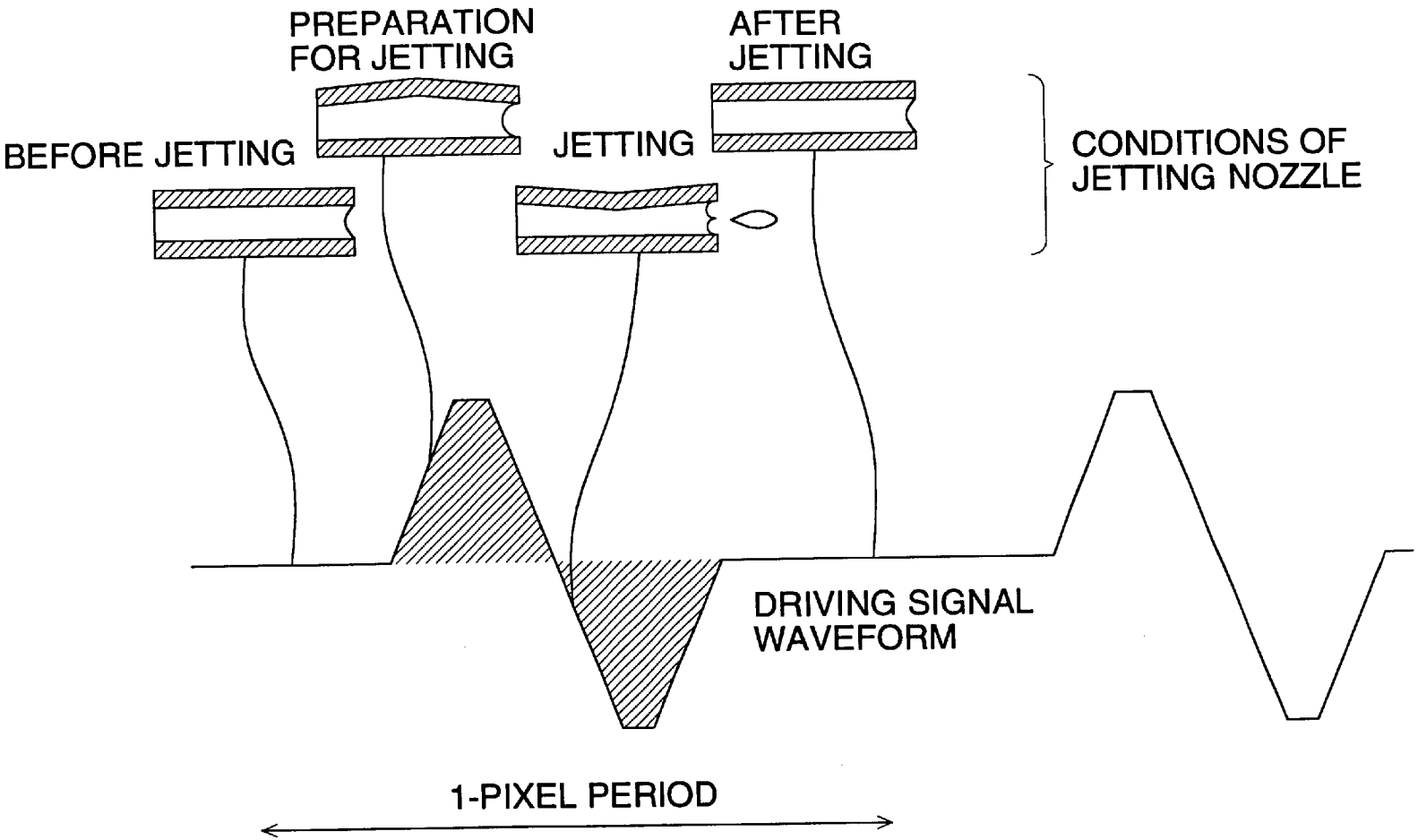
FIG. 11 is an illustration showing the principle of the ink jet printer.

As the operations were already explained in FIG. 11, piezo-elements 17*p* which jet liquid drops of the ink by expansion and contraction, are provided on the head 17 corresponding to each jetting nozzle. Further, the driver IC 17*d* to supply the drive signal or heating signal to piezo-elements 17*p* is located on an ink path (an ink bath).

The piezo-element is an example of the piezoelectric means of the present invention. Although there are various type ones as the piezoelectric means, the piezo-element will be explained below as an example in the present example.

A thermistor 19 is provided on the jetting nozzle near the piezo-element 17*p*, and constitutes a temperature measuring means. In this connection, the head shown in FIG. 4 is related to one color, and it is presupposed that a plurality of heads having the same structure are provided on the carriage 2 corresponding to the ink of a plurality of colors in a color ink jet printer.

<The Electrical Structure of the Overall Ink Jet Printer>

Figure 2:
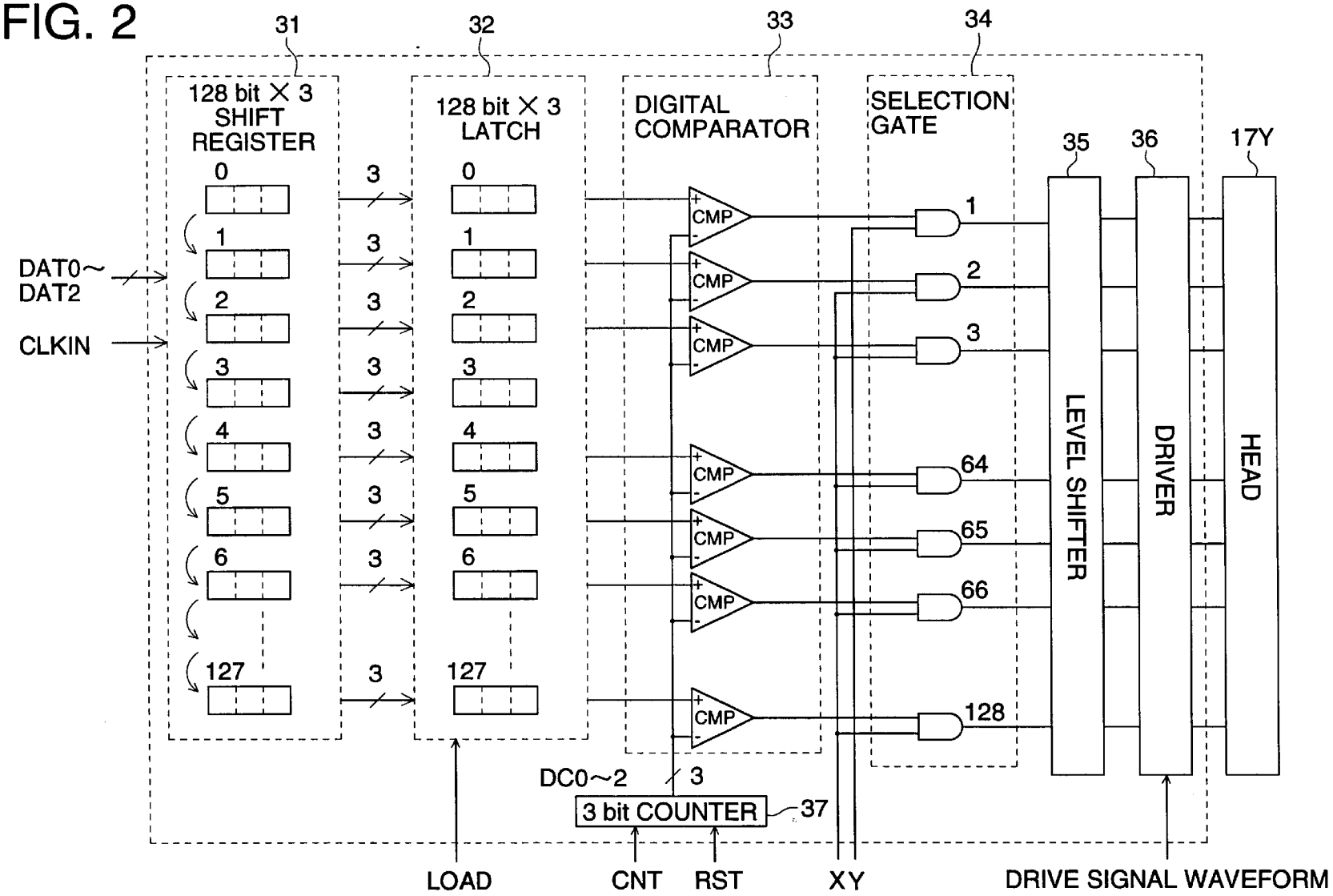
FIG. 2 is a block diagram showing the structure of a head driver in detail.

Next, the electrical structure of the ink jet printer will be described. FIG. 1 is a block diagram showing an example of the overall structure of the ink jet printer in an embodiment of the present invention. Further, FIG. 2 is a block diagram showing the primary portion in FIG. 1 in detail.

In FIG. 1, a CPU 11 as a control means which controls the overall ink jet printer 1 is equipped on a control substrate 9 shown by a broken line, and the control substrate 9 is connected to a head driver 16 of the carriage 2 with the flexible cable 5 as described previously.

A page memory 12 stores image data received from a personal computer, or the like, which uses the ink jet printer 1 itself as a peripheral equipment. The memory capacity of the page memory 12 may be determined corresponding to the number of bits of gradation image data used in a personal computer, or the like, the number of dots, the signal transfer speed, the processing speed of the CPU, etc.

The line memory 13*a* and 13*b* are used as the line memory which is aligned in the primary scanning direction, and which stores image data of each pixel to be recorded when image data is recorded on the recording sheet P, and each image data is transferred from the page memory 12 as gradation data in several bits. In the present example, two 6-bit processing line memory 13*a* and 13*b* are used in parallel, however, these memory may be structured by one 12-bit processing line memory.

A data signal line (data bus) from the page memory 12 is provided for 12 bits, and is branched to each line memory 13 for each 6 bits. Image data in the line memory 13*a* and 13*b* is transferred to a head driver 16 through the flexible cable 5.

Interfaces 14*a* and 14*b* are means for data transferring to and receiving from the outside personal computers, and are structured by either of each type of serial interface or parallel interface.

The head drivers 16*a* to 16*d* are composed of ICs, and one head driver is provided for each of 4 colors of Y, M, C, K in the present example. Each head driver is connected to 128 bits×3 shift registers, and image data from the line memory 13*a* and 13*b* is stored once in the shift registers. The shift register will be described later.

In this connection, a plurality of head drivers 16 may be provided for each color, and when drivers for 4 colors are integrated with one IC, more size reduction becomes possible. The head driver 16 has 3-bit data signal lines, and when the head drivers 16 are connected serially by the signal lines, the system can be structured so that image data which could not be accommodated in the front stage shift registers, is accommodated in the back stage shift registers.

Each of heads for 4 colors 17Y, 17M, 17C, 17K of the recording means of the present invention is respectively provided with 128 jet nozzles (hereinafter, simply referred to as nozzle), and nozzles constituting each head are aligned in the subsidiary scanning direction so that a plurality of lines are simultaneously recorded.

In the present embodiment, yellow (Y) image data is transferred from the line memory 13*a* to the head driver 16*a* through 3-bit data signal line. Then, the 128 yellow image data which is transferred to the head driver 16*a*, is processed in parallel, and recorded by the head 17Y.

Hereinafter, in the same manner, magenta (M) image data is transferred from the line memory 13*a* to the head driver 16*b*, and recorded by the head 17M. Cyan (C) image data is transferred from the line memory 13*b* to the head driver 16*c*, and recorded by the head 17C. Black (K) image data is transferred from the line memory 13*b* to the head driver 16*d*, and recorded by the head 17K. In this connection, detailed operations of these head drivers 16 will be described later.

An AND gate 18 outputs a TRGIN signal to start the ink jet to the head drivers 16 through a control circuit 23, at the time when the carriage 2 starts one going and returning movement according to information detected by an encoder 7, and reaches a predetermined position on the going way. The head driver 16 receives the TRGIN signal and sends out a drive signal to the head 17, and the head 17 jets the ink.

Respective head drivers 16*a* to 16*d* supply drive signals to piezo-elements provided on respective nozzles of heads 17Y to 17K through 128-bit data signal lines, and the ink in the head for each color is jetted when the piezo-elements are deformed by the drive signal.

Generally, in the ink jet printer, liquid drops of ink are jetted from nozzles corresponding to the drive signal, and thereby, recording is conducted. Liquid drops of ink are successively recorded onto the recording sheet P, and recording on the area corresponding to the number of liquid drops becomes possible, thereby, gradation recording can be conducted.

Further, when drive voltage of the piezo-element is increased, the speed of liquid drops jetted from the nozzle head 17 can be increased. Accordingly, before the first liquid drop jetted at the first arrives at the recording medium, the following liquid drop jetted succeedingly can catch up the first liquid drop. Whereby, since a plurality of liquid drops can arrive as a single liquid drop at the recording medium or at the same place on the recording medium, the image resolution can be enhanced in the case that the gradation is expressed by changing the number of liquid drops in comparison with a plurality of liquid drops separately arriving at the recording medium. By utilizing this, when the applied voltage for each jetting is gradually increased for each pulse, the successively jetted drops of ink can be recorded on a nearer position on the recording sheet P, thereby, gradation recording can be carried out with higher quality.

Still further, when the drive signal having a different waveform is used corresponding to circumstances around the ink jet printer 1, the more stable image quality can be obtained. In the present example, the temperature near the head 17 is measured by a thermistor 19, and the waveform is changed corresponding to the measured temperature. By this structure, even when the ink viscosity is changed by temperature, the head can be driven corresponding to that. In this connection, it is more desirable that humidity conditions are also used as a parameter to change the waveform of the drive signal.

In order to change the waveform of the drive signal every time when a drop of ink is jetted as described above, and further, in order to change the waveform also depending on the circumstance, various waveforms of the drive signal are stored in the line memory (not shown) in a drive waveform generating circuit 15 as digital data. The line memory can be structured using SRAMs, or the like.

In the line memory, waveform data of the drive signal, in which the applied voltage is gradually increased for each pulse, is stored for each temperature condition. In the present example, 3-bit (8-gradation) data is outputted for each color, therefore, waveform data stored in the line memory is digital data in which amplitude of the fundamental wavwform is gradually increased and the waveform repeated 8 times is digitized into digital data.

Incidentally, although 3-bit (8-gradation) is taken as an example here, other number of bits may be used, and the number of bits (the number of gradation) of each data or line memory data may be changed by being interlocked with each other.

The CPU 11 calculates the optimum waveform data for the temperature condition detected by the thermistor 19, and sends it to the drive waveform generating circuit 15. In the drive waveform generating circuit 15, the waveform data of the drive signal is demodulated into analog waveform by D/A conversion, amplified and outputted to head drivers 16*a* to 16*d*.

<The Electrical Structure of the Ink Jet Printer Driver>

Next, the explanation will be made referring to a block diagram showing the detail of the head driver in FIG. 2. In this connection, the structure of the head driver 16*a* and the head 17Y is shown here, however, head drivers 16*b* to 16*d* and heads 17M to 17K have also the same structure.

The head driver 16 in the present example includes a shift register 31, latch 32, digital comparator 33, selection gate 34, level shifter 35, driver 36, counter 37, etc.

In the present example, in order to process image data formed of 8-gradation per pixel, each means constituting the head driver 16 is structured corresponding to 3 bits.

The gradation image data, one pixel of which is composed of a plurality of bits, herein 3 bits, is serially transferred from the line memory 13 to the head driver 16*a* in a pixel unit. In FIG. 2, a condition in which the first 3-bit pixel data DAT0, DAT1, DAT2 are transferred through 3-bit data signal lines, is shown.

The shift register 31 has the capacity which can store the image data having pixels of the number corresponding to one jetting amount of the nozzle head 17. In the present example, the shift register 31 stores the image data for 128 pixels aligned in the subsidiary scanning direction. When the carriage 2 reaches a position appropriate for recording, the control circuit 23 outputs LOAD signal, and when the latch 32 receives the LOAD signal, the latch 32 latches the image data outputted in parallel from the shift register 31.

The digital comparator 33 is a comparison means of the present invention, and compares whether the value of image data latched by the latch 32 is larger or smaller than the count value of the counter 37. In the present example, because the image data is composed of 3 bits per pixel, the 3-bit counter is used. As the counter which is a comparison means, a counter corresponding to the number of bits of the image data may be appropriately used.

The digital comparator 33 and the counter 37 are supposed as a circuit to convert the latched 3 bit data into the pulse width. The counter 37 is a counter to count up independently every jetting interval from RST pulse. By comparing with the inputted data, the output of the comparator 33 continues H-level until the jetting number becomes proportional to the data. In other words, the selecting gate opens by the jetting number corresponding to the gradation data so that ink drops of the jetting number are jetted.

When the value of image data is larger than the value which is subtracted by 1 from the counted signal value, the digital comparator 33 outputs Hi level, and when the value of image data is not larger than the value which is subtracted by 1 from the counted signal value, the digital comparator 33 outputs Low level, and the output status is maintained until the result of the comparison changes. By this digital comparator 33, the parallel data formed of a plurality of bits is converted to 1-bit continuous data which is serial data.

The selection gate 34 switches nozzles of the head 17 so that these nozzles are divided into 2 groups of the odd-numbered ones and the even-numbered ones and these groups are successively driven. The selection gate 34 is composed of 128 parallel AND-gates, and the output terminal of each digital comparator 33 is connected to one input terminal of each AND-gate, and the other input terminal of the AND-gate is connected to the control circuit.

Herein, X and Y are selection signals for selectively using nozzles of the recording head 17, and outputted from the control circuit 23. In the present example, the recording means is divided into 2 groups of the odd-numbered one and the even-numbered one using the selection signals X and Y, and these groups are alternately driven, that is, these groups alternately jet the ink.

By this driving method, the ink is jetted from the adjoining nozzle every time when drops of ink for one pixel, that is, 16 drops of ink at the maximum are jetted. The reason is as follows: it is considered that, in the case where the jetting characteristic is different depending on each nozzle, when all nozzles are continuously used, uneven streaks, or the like, are generated on the image, and these uneven streaks, or the like, can be suppressed by such the alternately jetting driving method as described above. In the present example, although 2 groups of the even-numbered one and the odd-numbered one are used, the nozzle head 17 may be divided into more than 2 groups.

The level shifter 35 shifts a level of the drive signal, which is the output of the selection gate, to the source voltage necessary to drive the piezo-element.

When the output of the level shifter 35 is Hi, the drive signal is outputted from the driver 36. When the output of the level shifter 35 becomes Low, the drive signal is not outputted.

The drive signal waveform from the above-described drive waveform generating circuit 15 is supplied to the driver 36, and the driver 36 outputs the drive signal according to the drive signal waveform, corresponding to Hi/Low from the level shifter 35.

The output terminal of the driver 36*a* is connected to the piezo-element of each nozzle corresponding to the head 17Y. Herein, when the drive signal is supplied from the driver 36, the ink is jetted by vibrations of the piezo-element of the connected nozzle, and when the drive signal is not supplied, the jet of ink by the piezo-element of the nozzle connected to this terminal is not conducted.

[Explanation of the Operation of the Ink Jet Printer (Generation of the Drive Signal)]

Figure 5:
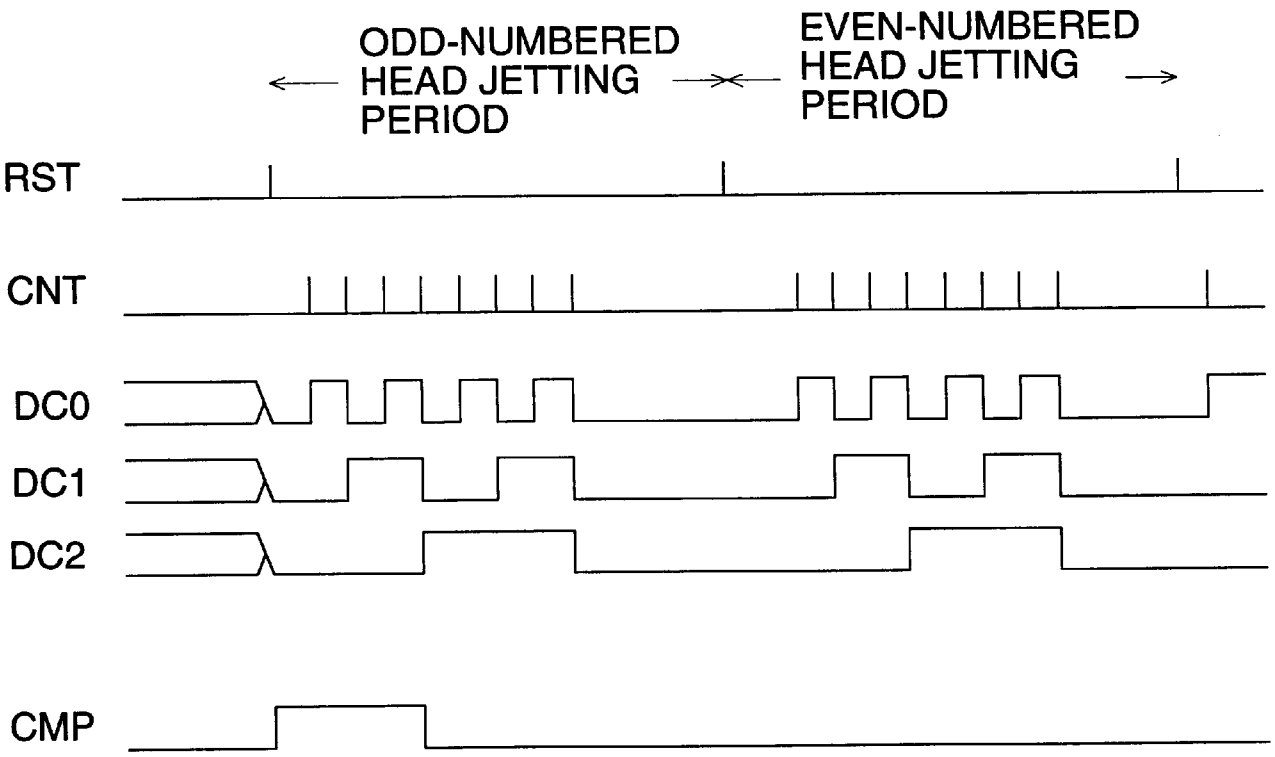
FIGS. 5(*a*) to 5(*f*) timing charts explaining the generation of a drive signal for jetting the whole of 8 gradation.

FIG. 5 is a timing chart explaining the generation of the drive signal when the ink is jetted in all 8-gradation.

The 3-bit counter 37 is a 3-bit up-counter which receives a counter signal CNT (FIG. 5(*b*)) and successively increases, and outputs count signals DC0 to DC2 according to the count signal of the present invention. The count value of the 3-bit counter 37 is reset to 0 by a reset signal RST (FIG. 5(*a*)).

A jetting signal CMP shown by FIG. 5(*f*) is an output of the digital comparator 33. Herein, the digital comparator 33 outputs a Hi-level when the value of image data is lager than the value in which 1 is subtracted from the value of the count signal,(the value is defined as the count value), and outputs a Low-level when the value of image data is not lager than the value in which 1 is subtracted from the value of the count signal, and the status of this output is maintained until the result of the comparison changes.

Incidentally, herein, the waveform of CMP when the value of image data is, for example, 4, is shown (FIG. 5(*f*)).

<Explanation ① of the Switching Operation Between the Drive-waveform and the Heat-waveform>

Herein, referring to an illustration in FIG. 6, a block diagram in FIG. 7 and a view of waveform in FIG. 8, the drive-waveform used when the drive signal is outputted, and the heat-waveform used when the heating signal is outputted, will be explained.

Figure 6:
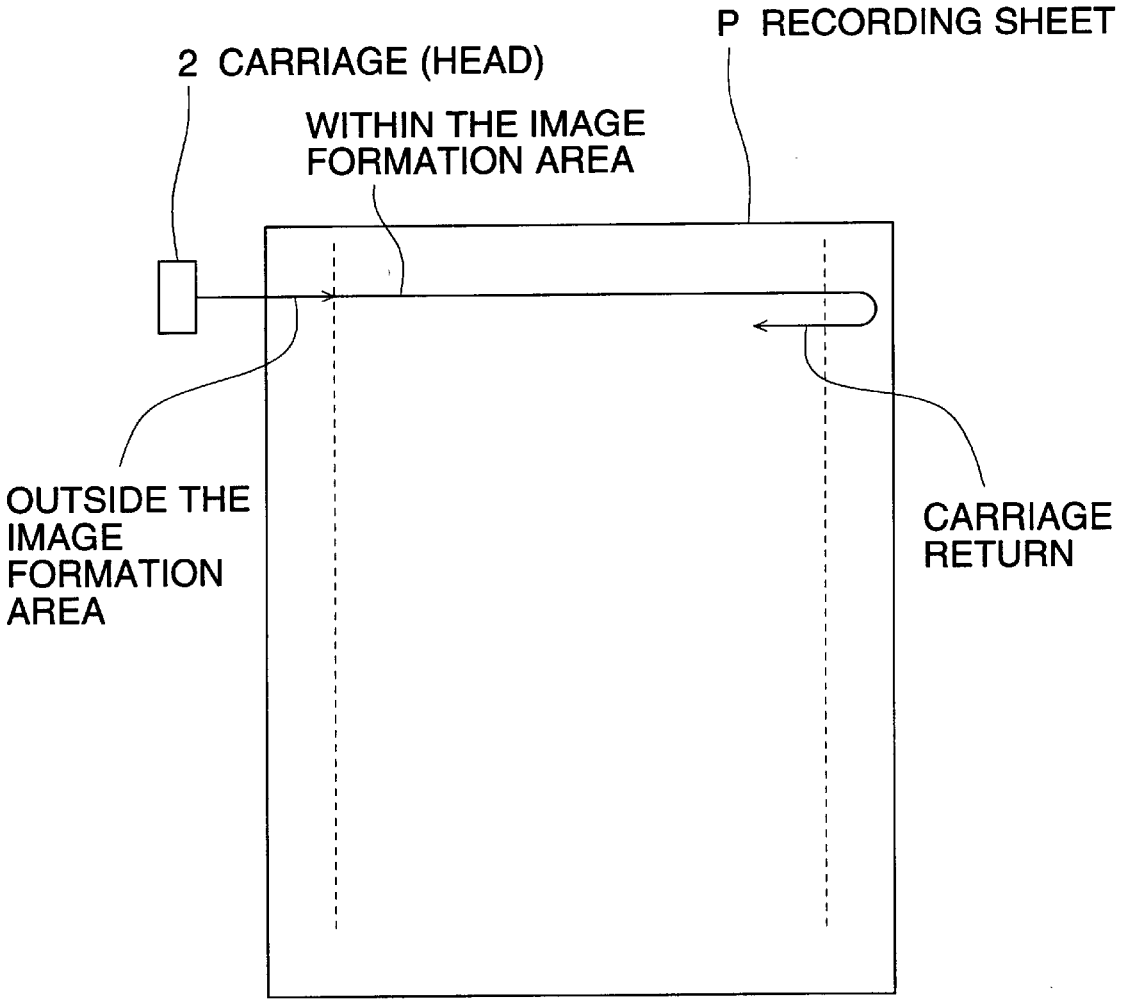
FIG. 6 is a view showing the inside of the image formation area and the outside the image formation area together with the moving direction of a carriage 2 as a model.

Initially, with the movement of the carriage 2, the head repeats movement to the outside of the image formation area (① in FIG. 6), within the image formation area (② in FIG. 6), the outside of the image formation area (① in FIG. 6), and to the carriage return area (③ in FIG. 6).

Within the image formation area, the ink is jetted as explained in FIG. 5. Further, the outside of the image formation area and the carriage return area correspond to the time of non-recording, and therefore, the ink is vibrated and the heat is generated as will be described later.

Figure 7:
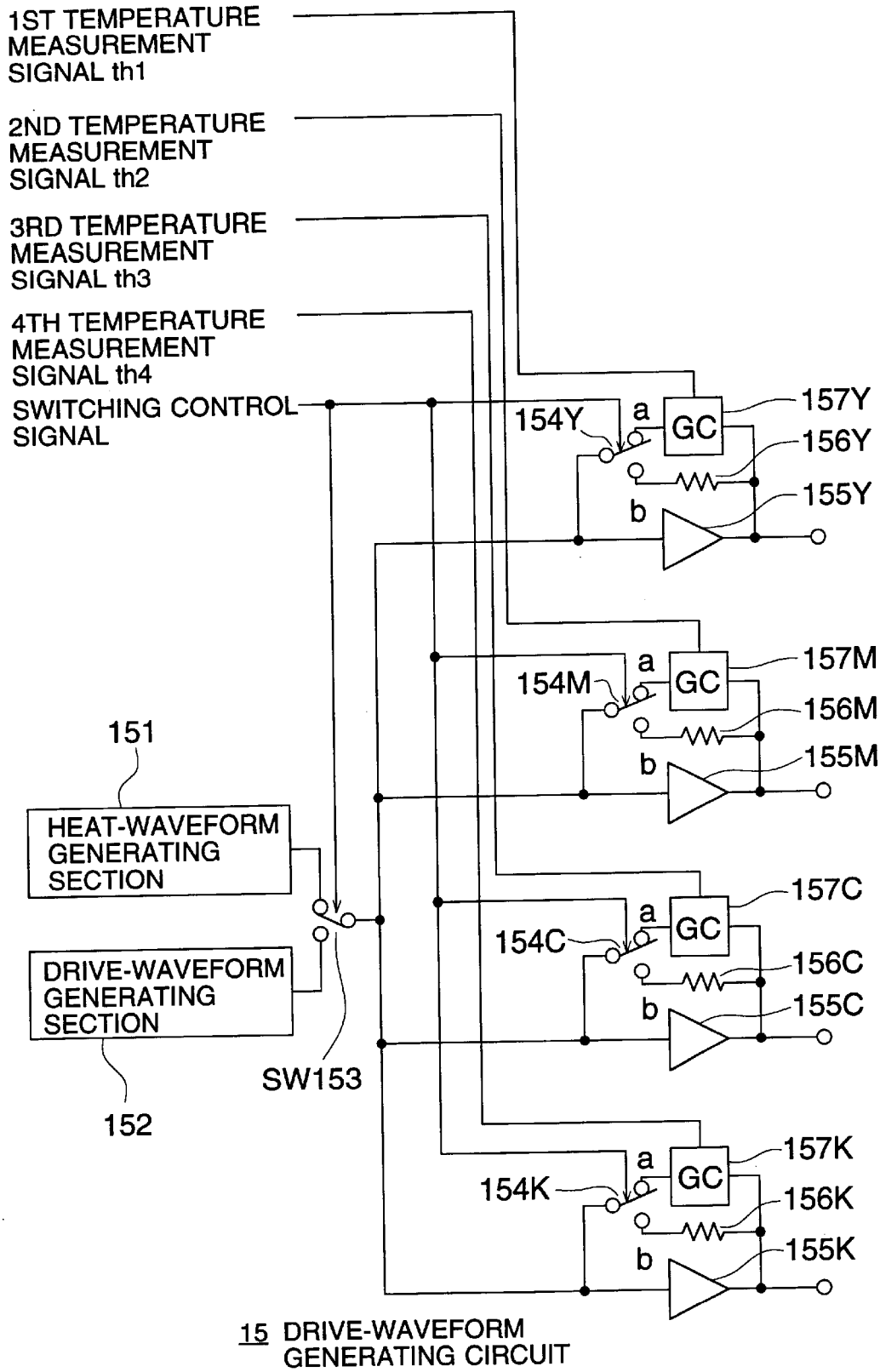
FIG. 7 is a block diagram showing the circuit structure when a heating waveform is controlled corresponding to temperature.

As shown in FIG. 7, the drive waveform generating circuit 15 has the heat-waveform generating section 151 to generate the heat-waveform, and the drive-waveform generating section 152 to generate the drive-waveform.

Figure 8:
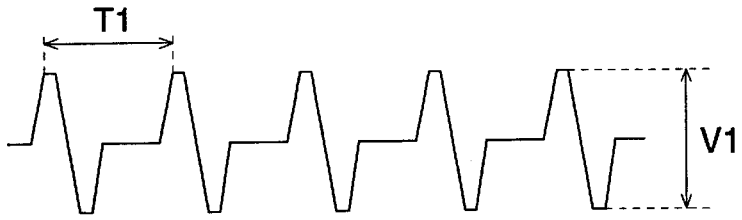
FIGS. 8(*a*) to 8(*e*) views of waveforms showing an example of a drive waveform and a heating waveform.
Figure 8:
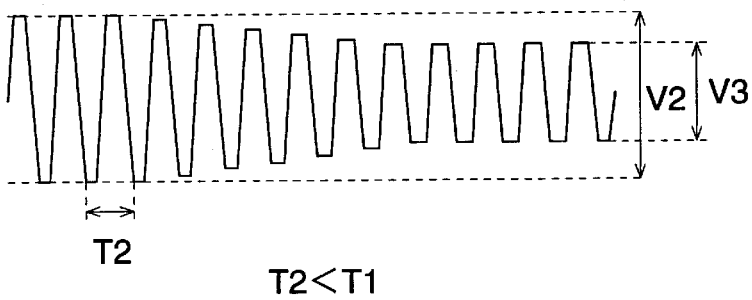
Figure 8:
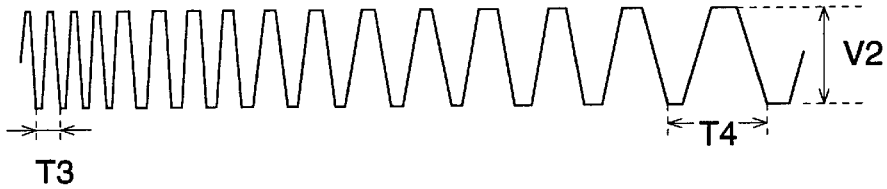
Figure 8:
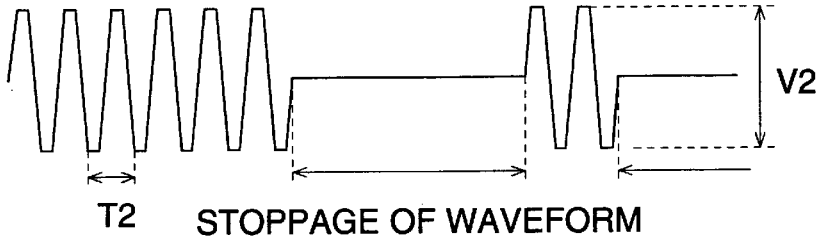
Figure 8:
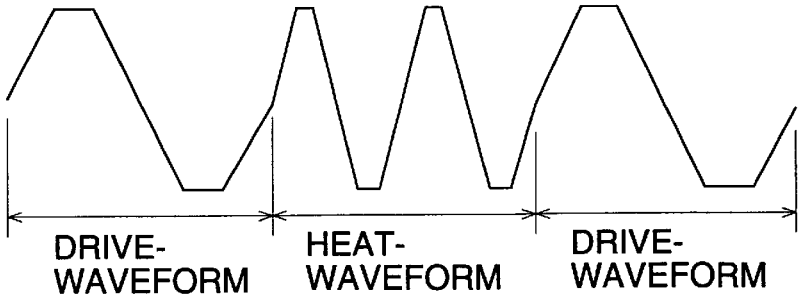

In this connection, the drive-waveform has the shape as shown in FIG. 8(*a*), and is the waveform to jet the ink by elongation and shrinkage of the piezo-element 17*p*. Accordingly, in order to efficiently jet the liquid drops of ink, the frequency of the drive-waveform determined by a period T1 is set so as to coincide with the resonance frequency of the head 17. Further, by the AND operation of this drive-waveform and the waveform shown in FIG. 5, the jet of liquid drops of ink for expression of the gradation, can be realized.

Further, the first example of the heat-waveform has the shape as shown in FIG. 8(*b*), which is the waveform to vibrate the piezo-element 17*p* under the condition that the ink is not jetted, and to generate the heat and transmit the heat to the ink in the head. Accordingly, a priod T2 is set so that the waveform has the frequency higher than the above-described resonance frequency of the head so as not to jet the liquid drops of ink. In this connection, the heat-waveform from the heat-waveform generating section 151 has a constant amplitude, however, it is structured such that its amplitude is changed from V2 to V3 by the gain control, which will be described later, according to the temperature measuring signal from the thermistor 19 near the head 17 (or the temperature measuring signal in which the detection result from the thermistor 19 is processed by the CPU 11).

Initially, when the carriage exists outside the image area or in the carriage return area, a switch 153 and switches 154Y to 154K are switched to a-side by a switching control signal from the CPU 11. According to this, the heat-waveform with a constant amplitude from the heat-waveform generating section 151 is supplied to each of amplifiers 155Y to 155K.

At this time, the first temperature measuring signal th1 to the fourth temperature measuring signal th4 are respectively applied to each of the gain control circuits 157Y to 157K, and the amplitude of the heat-waveform changes corresponding to the temperature of the head as shown by FIG. 8(*b*). Concretely, the following control is conducted: when the temperature of the head is low, the amplitude of the heat-waveform becomes large, and when the temperature of the head is high, the amplitude of the heat-waveform becomes small.

In this case, the amplitude of the heat-waveform is proportional to energy, therefore, when the amplitude is increased, energy for heating is also increased. Accordingly, when the amplitude of the heating signal is controlled, delicate temperature adjustment or quick heating can also be conducted.

When such the higher frequency heat-waveform is supplied to the piezo-element 17*p* of each head, the head is vibrated at higher frequency then the resonance frequency, thereby, the ink is not jetted, and the drive current for the piezo-element 17*p* is converted into the heat, so that the ink near the piezo-element 17*p* is heated and the temperature is increased. Further, in also the driver IC 17*d* to generate the drive current, the heat corresponding to the drive current is generated, thereby, the ink near the driver IC 17*d* is heated and the temperature is increased.

Further, the amplitude of the heat-waveform is independently controlled for each head according to the temperature measuring signal by the thermistor 19, thereby, the temperature of each color ink of Y, M, C, K is controlled so as to be equal. As the result, it is not necessary to provide any outside fitting part for heating near the head, thereby, a bad influence onto the image, caused by the change of the ink viscosity due to the temperature, can be avoided.

Incidentally, when the head enters the image formation area, the switch 153 and switches 154Y to 154K are switched to b-side by the switching control signal from the CPU 11. Thereby, the drive-waveform from the drive-waveform generating section 152 is supplied to each of amplifiers 155Y to 155K on the fixed gain condition, and the image formation by the ordinary ink jetting is conducted.

<Explanation ② of the Switching Operation Between the Drive-waveform and the Heat-waveform>

Herein, the second example of the heat-waveform used when the heating signal is outputted, will be described referring to a block diagram in FIG. 9 and a view of waveform in FIG. 8.

Figure 9:
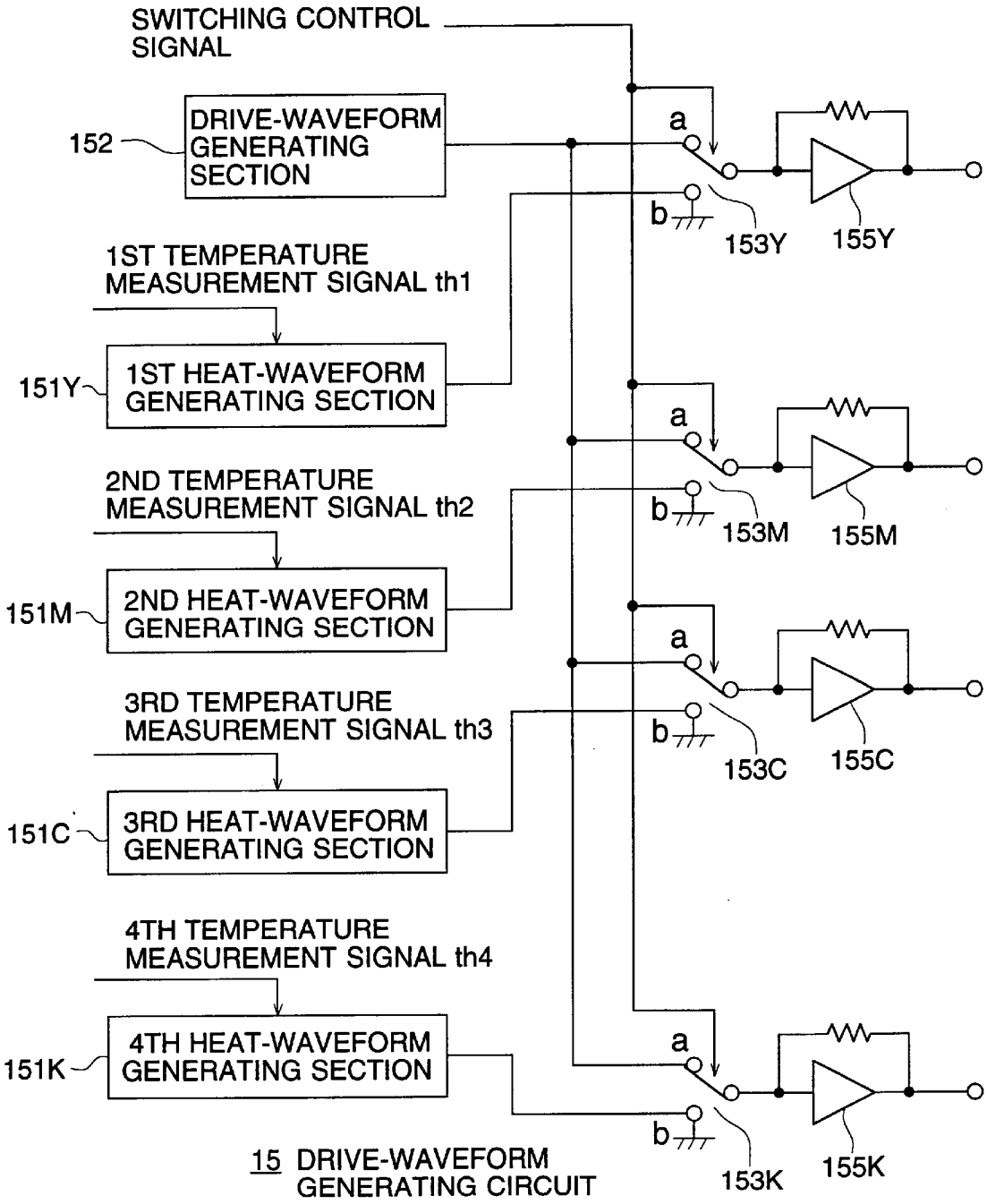
FIG. 9 is a block diagram showing the circuit structure when the heating waveform is controlled corresponding to temperature.

As shown in FIG. 9, the drive-waveform generating circuit 15 has the first heat-waveform generating section 151Y to the fourth heat-waveform generating section 151K, which generate heat-waveforms, and the drive-waveform generating section 152 which generates the drive-waveform.

Herein, the second example of the heat-waveform has the shape as shown in FIG. 8(*c*), which is the waveform to vibrate the piezo-element 17*p* under the condition that the ink is not jetted, and to generate the heat and transmit the heat to the ink in the head. Accordingly, priods T3 and T4 are set so that the waveform has the frequency higher than the above-described resonance frequency of the head so as not to jet the liquid drops of ink, or even when the frequency is within the resonance frequency of the head, the amplitude of the heat-waveform is set so that the ink is not jetted.

In this connection, the frequency of the heat-waveform from the first heat-waveform generating section 151Y to the fourth heat-waveform generating section 151K changes according to the temperature measuring signal from the thermistor 19 near the head 17 (or the temperature measuring signal in which the detection result from the thermistor 19 is processed by the CPU 11).

Initially, when the carriage exists outside the image area or in the carriage return area, switches 153Y to 153K are switched to a-side by a switching control signal from the CPU 11. According to this, the constant amplitude heat-waveforms whose frequency change, from the first heat-waveform generating section 151Y~the fourth heat-waveform generating section 151K are supplied to each of amplifiers 155Y to 155K.

At this time, the first temperature measuring signal th1 to the fourth temperature measuring signal th4 are respectively applied to each of the first heat-waveform generating section 151Y~the fourth heat-waveform generating section 151K, and the frequency of the heat-waveform changes corresponding to the temperature of the head as shown by FIG. 8(*c*). Concretely, the following control is conducted: when the temperature of the head is low, the frequency of the heat-waveform becomes high, and when the temperature of the head is high, the frequency of the heat-waveform becomes low.

In this case, the frequency of the heat-waveform is proportional to energy, therefore, when the frequency is increased, energy for heating is also increased. Accordingly, when the frequency of the heating signal is controlled, delicate temperature adjustment or quick heating can also be conducted.

When such the higher frequency heat-waveform is supplied to the piezo-element 17*p* of each head, the head is vibrated by the voltage not larger than the voltage by which the ink can be jetted, therefore, the ink is not jetted, and the drive current for the piezo-element 17*p* is converted into the heat, so that the ink near the piezo-element 17*p* is heated and the temperature is increased. Further, in also the driver IC 17*d* to generate the drive current, the heat corresponding to the drive current is generated, thereby, the ink near the driver IC 17*d* is heated and the temperature is increased.

Further, the frequency of the heat-waveform is independently controlled for each head according to the temperature measuring signal by the thermistor 19, thereby, the temperature of each color ink of Y, M, C, K is controlled so as to be equal. As the result, it is not necessary to provide any outside fitting part for heating near the head, thereby, a bad influence onto the image, caused by the change of the ink viscosity due to the temperature, can be avoided.

Incidentally, when the head enters the image formation area, the switch 153 and switches 154Y to 154K are switched to b-side by the switching control signal from the CPU 11.

Thereby, the drive-waveform from the drive-waveform generating section 152 is supplied to each of amplifiers 155Y to 155K, and the image formation by the ordinary ink jetting is conducted.

[Explanation ③ of the switching operation between the drive-waveform and the heat-waveform]

Herein, the third example of the heat-waveform used when the heating signal is outputted, will be described referring to a block diagram in FIG. 10 and a view of waveforms in FIG. 8.

Figure 10:
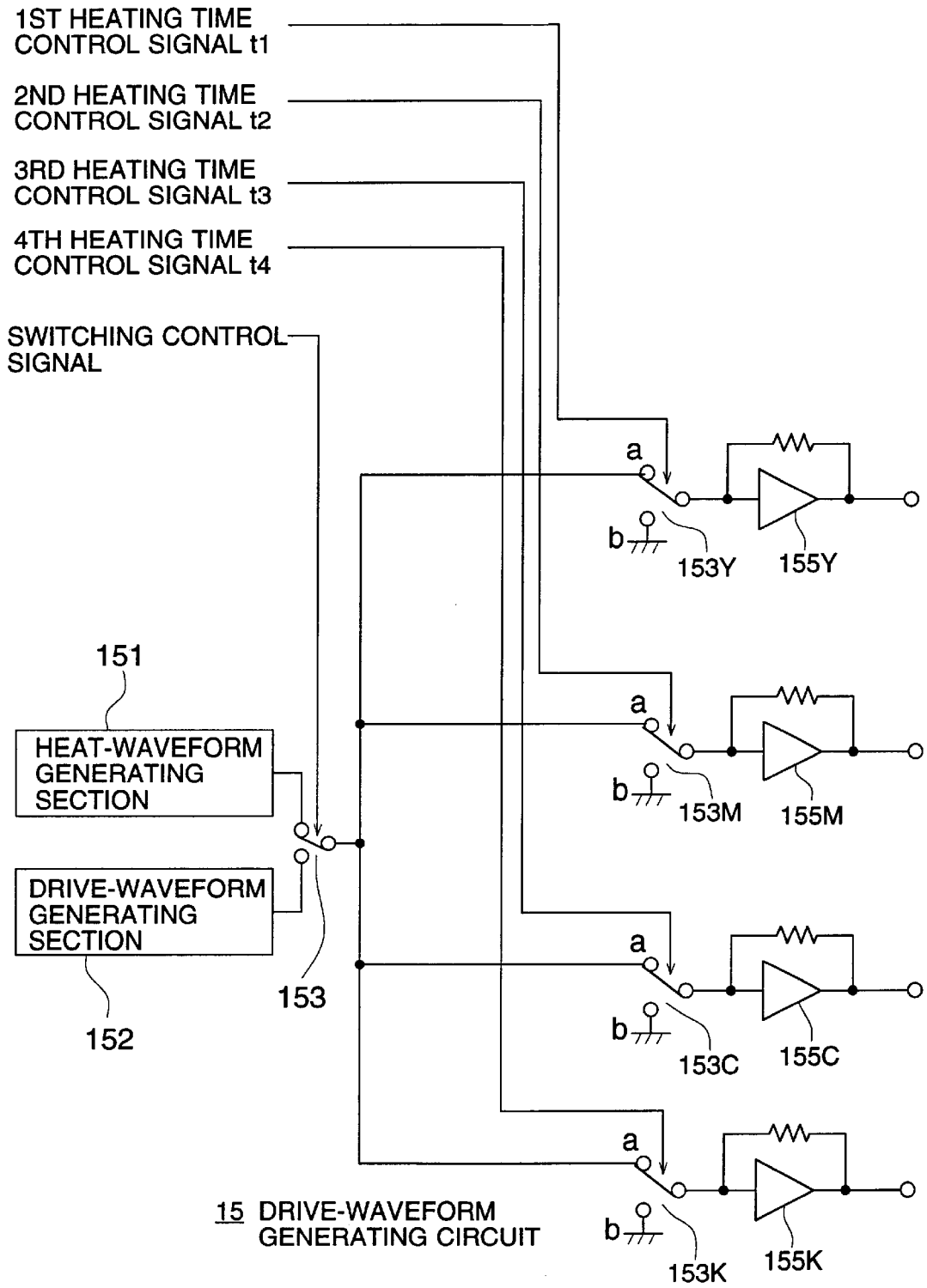
FIG. 10 is a block diagram showing the circuit structure when the heating waveform is controlled corresponding to temperature.

As shown in FIG. 10, the drive-waveform generating circuit 15 has the first heat-waveform generating section 151Y to the fourth heat-waveform generating section 151K, which generate heat-waveform, and the drive-waveform generating section 152 which generates the drive-waveform.

Herein, the third example of the heat-waveform has the shape as shown in FIG. 8(*d*), which is the waveform to vibrate the piezo-element 17*p* under the condition that the ink is not jetted, and to generate the heat and transmit the heat to the ink in the head. Accordingly, a period T2 is set so that the waveform has the frequency higher than the above-described resonance frequency of the head so as not to jet the liquid drops of ink.

Incidentally, the heat-waveform from the heat-waveform generating section 151 is formed of continuous pulses, and this system is structured so that a heating amount is controlled when a ratio of ON (passage)/OFF (shut-off) of switches 154Y to 154K is switched according to the first heating time control signal ti to the fourth heating time control signal t4, which are generated by processing the detection result from the thermistor 19 near the head 17 by the CPU 11.

Initially, when the carriage exists outside the image area or in the carriage return area, the switch 153 is switched to a-side by a switching control signal from the CPU 11. According to this, the constant amplitude heat-waveform from the heat-waveform generating section 151 is supplied to each of switches 154Y to 154K.

At this time, the first heating time control signal tl to the fourth heating time control signal t4 are applied to each of switches 154Y to 154K, and the passage of the heat-waveform (condition of a-side) is switched to the shut-off of the heat-waveform (condition of b-side).

Concretely, the system is controlled such that, when the temperature of the head is low, a passage ratio of the heat-waveform is increased, and when the temperature of the head is high, a passage ratio of the heat-waveform is decreased. For example, 10 pulses of the heat-waveform is defined as 1 basic unit, and the CPU 11 conducts heating control depending on how many pulses of these 10 pulses pass through the circuit. In FIG. 8(*d*), a case where 6 pulses of 10 pulses are passed, and a case where 2 pulses are passed, are shown as an example.

In this case, a passage ratio of the heat-waveform is proportional to energy, therefore, when the passage ratio is increased, energy for heating is also increased. Accordingly, when a passage ratio (passage time) of the heating signal is controlled, delicate temperature adjustment or quick heating can also be conducted.

When such the higher frequency heat-waveform is supplied to the piezo-element 17*p* of each head, the head is vibrated at the frequency higher than the resonance frequency, therefore, the ink is not jetted, and the drive current for the piezo-element 17*p* is converted into the heat, so that the ink near the piezo-element 17*p* is heated and the temperature is increased. Further, in also the driver IC 17*d* to generate the drive current, the heat corresponding to the drive current is generated, thereby, the ink near the driver IC 17*d* is heated and the temperature is increased.

Further, the amplitude of the heat-waveform is independently controlled for each head according to the heating time control signal generated from the temperature measuring signal by the thermistor 19, thereby, the temperature of each color ink of Y, M, C, K is controlled so as to be equal. As the result, it is not necessary to provide any outside fitting part for heating near the head, thereby, a bad influence onto the image, caused by the change of the ink viscosity due to the temperature, can be avoided.

Incidentally, when the head enters the image formation area, the switch 153 is switched to b-side, and switches 154Y to 154K are fixed at a-side by the switching control signal from the CPU 11. Thereby, the drive-waveform from the drive-waveform generating section 152 is supplied to each of amplifiers 155Y to 155K, and the image formation by the ordinary ink jetting is conducted.

<Other Example ①>

In the above explanation, the amplitude control, frequency control and duty control of the heat-waveform are described as an example, and further, 2 or 3 of these control may be arbitrarily combined. When these are thus combined, more quick heating or more delicate heating can also be realized.

<Other Example ②>

In each of above examples, an ink jet printer using 4 colors of Y, x, C, K is described as an example, however, even when the other colors are used, only monochrome is used, or other number of gradations is used, secured temperature control of the ink can be conducted by the structure and operations shown in each example.

<Other Example ③>

In the examples described above, the heat-waveform is applied onto the head when the head exists outside the image area or in the carriage return area, however, even when the head exists within the image formation area, the heat-waveform may be applied onto the head of the color by which image data is not outputted, by the control of the CPU 11. When thus controlled, the temperature control of the head of the color whose frequency in use is relatively low, can be securely conducted.

Further, with the similar manner, as shown in FIG. 8(*e*), heating waveform may be applied onto the nozzles which do not output image data.

Furthermore, it may be preferable that the frequency of heating waveform is (2f±50%), wherein f is a frequency of driving waveform. Also, it may be preferable that the amplitude of heating waveform is (0.5V±80%), wherein V is an amplitude of driving waveform.

Further, the generation of the heating signal is not limited to the region other than the image forming region, it may be possible that the heating signal may be gene rated when an image is not recorded, that is, when the image data do not jet ink drops from the nozzles.

As detailed above, according to each invention written in this specification, the following effects can be obtained.

In the ink jet printer in Item 1, the ink in the liquid accommodation chamber adjacent to the piezoelectric means is heated without jetting any liquid drop from the leading end of the nozzle, by the thermal conduction from the piezoelectric means heated by the heating signal, applied to the piezoelectric means.

Accordingly, because the piezoelectric means to jet the ink is also used for ink heating, it is not necessary to provide any outside fitting part for heating near the head, thereby, a bad influence onto the image, caused by the change of the ink viscosity due to the temperature, can be avoided.

In the ink jet printer in Item 2, the ink in the liquid accommodation chamber adjacent to the piezoelectric means is heated without jetting any liquid drop from the leading end of the nozzle, at the time of non-recording, by the thermal conduction from the piezoelectric means heated by the heating signal, applied to the piezoelectric means.

Accordingly, because the piezoelectric means to jet the ink is also used for ink heating, and heating is conducted at the time of non-recording, it is not necessary to provide any outside fitting part for heating near the head, thereby, a bad influence onto the image, caused by the change of the ink viscosity due to the temperature, can be avoided.

In the ink jet printer in Item 3, the ink in the liquid accommodation chamber adjacent to the piezoelectric means is heated, when the head exists outside the image formation area, without jetting any liquid drop from the leading end of the nozzle, by the thermal conduction from the piezoelectric means heated by the heating signal, applied to the piezoelectric means.

Accordingly, because the piezoelectric means to jet the ink is also used for ink heating, and heating is conducted when the head exists outside the image formation area, it is not necessary to provide any outside fitting part for heating near the head, thereby, a bad influence onto the image, caused by the change of the ink viscosity due to the temperature, can be avoided.

In the ink jet printer in Item 4, the ink in the liquid accommodation chamber adjacent to the piezoelectric means is heated without jetting any liquid drop from the leading end of the nozzle, by the thermal conduction from the piezoelectric means heated by the heating signal whose amplitude changes corresponding to the temperature.

Accordingly, because the piezoelectric means to jet the ink is also used for ink heating, and heating is conducted by the heating signal whose amplitude is controlled, it is not necessary to provide any outside fitting part for heating near the head, thereby, a bad influence onto the image, caused by the change of the ink viscosity due to the temperature, can be avoided.

In this case, the amplitude is proportional to energy, therefore, when the amplitude is increased, the energy for heating is increased. Accordingly, when the amplitude of the heating signal is controlled, delicate temperature adjustment or quick heating can also be conducted.

In the ink jet printer in Item 5, the ink in the liquid accommodation chamber adjacent to the piezoelectric means is heated without jetting any liquid drop from the leading end of the nozzle, by the thermal conduction from the piezoelectric means heated by the heating signal whose frequency changes corresponding to the temperature.

Accordingly, because the piezoelectric means to jet the ink is also used for ink heating, and heating is conducted by the heating signal whose frequency is controlled, it is not necessary to provide any outside fitting part for heating near the head, thereby, a bad influence onto the image, caused by the change of the ink viscosity due to the temperature, can be avoided.

In this case, the frequency is proportional to energy, therefore, when the frequency is increased, the energy for heating is also increased. Accordingly, when the frequency of the heating signal is controlled, delicate temperature adjustment or quick heating can also be conducted.

In the ink jet printer in Item 6, the ink in the liquid accommodation chamber adjacent to the piezoelectric means is heated without jetting any liquid drop from the leading ends of nozzles of a plurality of heads, by the thermal conduction from the piezoelectric means heated by the heating signal which is selected and applied by the control means.

Accordingly, because the piezoelectric means to jet the ink is also used for ink heating, it is not necessary to provide any outside fitting part for heating near each head, thereby, a bad influence onto the image, caused by the change of the ink viscosity due to the temperature, can be avoided.

In the ink jet printer in Item 7, the ink in the liquid accommodation chamber adjacent to the piezoelectric means is heated at the time of non-recording of each head, without jetting any liquid drop from the leading end of the nozzle, by the thermal conduction from the piezoelectric means heated by the heating signal which is selected and applied by the control means.

In this case, even when any of heads is in recording, heating by vibration can be conducted for other non-recording heads.

Accordingly, because the piezoelectric means to jet the ink is also used for ink heating, and heating is conducted at the time of non-recording of each head, it is not necessary to provide any outside fitting part for heating near the head, thereby, a bad influence onto the image, caused by the change of the ink viscosity due to the temperature, can be avoided.

In the ink jet printer in Item 8, the ink in the liquid accommodation chamber adjacent to the piezoelectric means is heated, when each head exists outside the image formation area, without jetting any liquid drop from the leading end of the nozzle, by the thermal conduction from the piezoelectric means heated by the heating signal, which is selected and applied by the control means.

Accordingly, because the piezoelectric means to jet the ink is also used for ink heating, and heating is conducted when each head exists outside the image formation area, it is not necessary to provide any outside fitting part for heating near each head, thereby, a bad influence onto the image, caused by the change of the ink viscosity due to the temperature, can be avoided.

In the ink jet printer in Item 9, the ink in the liquid accommodation chamber adjacent to the piezoelectric means of each head is heated without jetting any liquid drop from the leading end of the nozzle, by the thermal conduction from the piezoelectric means heated by the heating signal, which is selected by the control means and whose amplitude changes corresponding to the temperature.

Accordingly, because the piezoelectric means to jet the ink is also used for ink heating, and heating is conducted by the heating signal whose amplitude is controlled for each head, it is not necessary to provide any outside fitting part for heating near each head, thereby, a bad influence onto the image, caused by the change of the ink viscosity due to the temperature, can be avoided.

In this case, the amplitude is proportional to energy, therefore, when the amplitude is increased, the energy for heating is also increased. Accordingly, when the amplitude of the heating signal is controlled, delicate temperature adjustment or quick heating for each head can also be conducted.

In the ink jet printer in Item 10, the ink in the liquid accommodation chamber adjacent to the piezoelectric means of each head is heated without jetting any liquid drop from the leading end of the nozzle, by the thermal conduction from the piezoelectric means heated by the heating signal, which is selected by the control means and whose frequency changes corresponding to the temperature.

Accordingly, because the piezoelectric means to jet the ink is also used for ink heating, and heating is conducted by the heating signal whose frequency is controlled for each head, it is not necessary to provide any outside fitting part for heating near each head, thereby, a bad influence onto the image, caused by the change of the ink viscosity due to the temperature, can be avoided.

In this case, the frequency is proportional to energy, therefore, when the frequency is increased, the energy for heating is also increased. Accordingly, when the frequency of the heating signal is controlled, delicate temperature adjustment or quick heating for each head can also be conducted.

What is claimed is:

1. An ink printer, comprising:

a printing head having an ink chamber to store an ink, a piezoelectric device arranged to apply pressure onto the ink chambers and a nozzle tip to jet ink drops;

drive signal generating means for generating drive signals corresponding to image information, wherein the piezoelectric device applies pressure onto the ink chamber in response to the drive signals so that ink drops are jetted through the nozzle tip onto an image recording medium and an image corresponding to the image information is recorded on the image recording medium;

a temperature measuring device which measures the temperature of the printing head; and heating signal generating means for generating a heating signal on the basis of the temperature of the printing head measured by the temperature measuring device, wherein the piezoelectric device vibrates in response to the heating signal and generates heat so that the ink in the ink chamber is heated; and wherein the heating signal is an oscillating signal having an amplitude and a frequency and wherein the heating signal generating means regulates the amplitude of the heating signal in accordance with the temperature of the printing head measured by the temperature measuring device.

2. The ink jet printer of claim 1, wherein the heating signal generating means outputs the heating signal to the piezoelectric device when the image is not recorded on the image recording medium.

3. The ink jet printer of claim 1, wherein the printing head is moved relative to the image recording medium on which an image forming region and a non image forming region are arranged, and wherein the heating signal generating means outputs the heating signal to the piezoelectric device when the printing head is moved on the non image forming region.

4. An ink jet printer, comprising:

a printing head having an ink chamber to store an ink, a piezoelectric device arranged to apply pressure onto the ink chamber, and a nozzle tip to let ink drops;

drive signal generating means for generating drive signals corresponding to image information, wherein the piezoelectric device applies pressure onto the ink chamber in response to the drive signals so that ink drops are jetted through the nozzle tip onto an image recording medium and an image corresponding to the image information is recorded on the image recording medium;

a temperature measuring device which measures the temperature of the printing head; and heating signal generating means for generating a heating signal on the basis of the temperature of the printing head measured by the temperature measuring device, wherein the piezoelectric device vibrates in response to the heating signal and generates heat so that the ink in the ink chamber is heated; and wherein the heating signal is an oscillating signal having an amplitude and a frequency and wherein the heating signal generating means regulates the frequency of the heating signal in accordance with the temperature of the printing head measured by the temperature measuring device.

5. The ink jet printer of claim 4, wherein the heating signal generating means outputs the heating signal to the piezoelectric device when the image is not recorded on the image recording medium.

6. The ink jet printer of claim 4, wherein the printing head is moved relative to the image recording medium on which an image forming region and a non image forming region are arranged, and wherein the heating signal generating means outputs the heating signal to the piezoelectric device when the printing head is moved on the non image forming region.

7. An ink jet printer, comprising:

a plurality of printing heads each having an ink chamber to store an ink, a piezoelectric device arranged to apply pressure onto the ink chambers and a nozzle tip to jet ink drops;

drive signal generating means for generating drive signals corresponding to image information, wherein the piezoelectric device of each printing head applies pressure onto the ink chamber of each printing head in response to the drive signals so that ink drops are jetted through the nozzle tip of each printing head onto an image recording medium and an image corresponding to the image information is recorded on the image recording medium;

a temperature measuring device which measures the temperature of each printing head;

heating signal generating means for generating a heating signal on the basis of the temperature of each printing head measured by the temperature measuring device, wherein the piezoelectric device of each printing head vibrates in response to the heating signal and generates heat so that the ink in the ink chamber of each printing head is heated; and control means for selectively applying one of the drive signals and the heating signal to the piezoelectric device; and wherein the heating signal is an oscillating signal having an amplitude and a frequency and wherein the heating signal generating means regulates the amplitude of the heating signal in accordance with the temperature of each printing head measured by the temperature measuring device.

8. The ink jet printer of claim 7, wherein the control means selects the heating signals and applies the heating signals to the piezoelectric device when the image is not recorded on the image recording medium.

9. The ink jet printer of claim 8, wherein the control means selects the heating signals and applies the heating signals to the piezoelectric device when the image information represents non-image recording.

10. The ink jet printer of claim 7, wherein the printing head is moved relative to the image recording medium on which an image forming region and a non image forming region are arranged, and wherein the control means selects the heating signal and applies the heating signals to the piezoelectric device when the printing head is moved on the non image forming region.

11. The ink jet printer of claim 7, wherein the control means selects the heating signals in accordance with the image information and applies the heating signals to the piezoelectric device.

12. An ink jet printer, comprising:

a plurality of printing heads each having an ink chamber to store an ink, a piezoelectric device arranged to apply pressure onto the ink chamber, and a nozzle tip to let ink drops;

drive signal generating means for generating drive signals corresponding to image information, wherein the piezoelectric device of each printing head applies pressure onto the ink chamber of each printing head in response to the drive signals so that ink drops are jetted through the nozzle tip of each printing head onto an image recording medium and an image corresponding to the image information is recorded on the image recording medium;

a temperature measuring device which measures the temperature of each printing head;

heating signal generating means for generating a heating signal on the basis of the temperature of each printing head measured by the temperature measuring device, wherein the piezoelectric device of each printing head vibrates in response to the heating signal and generates heat so that the ink in the ink chamber of each printing head is heated; and control means for selectively applying one of the drive signals and the heating signal to the piezoelectric device; and wherein the heating signal is an oscillating signal having an amplitude and a frequency and wherein the heating signal generating means regulates the frequency of the heating signal in accordance with the temperature of each printing head measured by the temperature measuring device.

13. The ink jet printer of claim 12, wherein the control means selects the heating signals and applies the heating signals to the piezoelectric device when the image is not recorded on the image recording medium.

14. The ink jet printer of claim 12, wherein the control means selects the heating signals and applies the heating signals to the piezoelectric device when the image information represents non-image recording.

15. The ink jet printer of claim 12, wherein the printing head is moved relative to the image recording medium on which an image forming region and a non image forming region are arranged, and wherein the control means selects the heating signal and applies the heating signals to the piezoelectric device when the printing head is moved on the non image forming region.

16. The ink jet printer of claim 12, wherein the control means selects the heating signals in accordance with the image information and applies the heating signals to the piezoelectric device.

* * * * *